United States Patent [19]

Grützmacher et al.

[11] Patent Number: 4,909,500

[45] **Date of Patent: * Mar. 20, 1990**

[54] DEVICE FOR CONVEYING SHEETS, FOR EXAMPLE PAPER SHEETS

[75] Inventors: Bertold Grützmacher, Schriesheim; Peter T. Blaser, Dielheim, both of Fed. Rep. of Germany

[73] Assignee: Heidelberger Druckmaschinen AG, Heidelberg, Fed. Rep. of Germany

[ * ] Notice: The portion of the term of this patent subsequent to Dec. 19, 2006 has been disclaimed.

[21] Appl. No.: 174,087

[22] Filed: Mar. 28, 1988

[30] Foreign Application Priority Data

Mar. 28, 1987 [DE] Fed. Rep. of Germany ..... 3710258

[51] Int. Cl.[4] ..... B65H 3/64

[52] U.S. Cl. ..... 271/112; 271/126; 271/251; 414/797

[58] Field of Search ..... 271/112, 113, 109, 4, 271/5, 10, 11, 114, 117, 126, 196, 194, 314, 226, 251; 414/121, 123; 384/512, 610

[56] References Cited

U.S. PATENT DOCUMENTS

| | | | |
|---|---|---|---|
| 3,610,714 | 10/1971 | DeGaeta | 384/610 X |
| 3,848,752 | 11/1974 | Branch et al. . | |
| 3,908,986 | 9/1975 | Bleau | 271/227 |
| 4,266,762 | 5/1981 | Kramer et al. | 271/251 X |
| 4,381,212 | 4/1983 | Roberts | 271/112 X |
| 4,411,418 | 10/1983 | Poehlein | 271/251 X |
| 4,669,718 | 6/1987 | Rovin | 271/227 |
| 4,730,824 | 3/1988 | Huau et al. | 271/251 X |

FOREIGN PATENT DOCUMENTS

| | | | |
|---|---|---|---|
| 830344 | 2/1952 | Fed. Rep. of Germany | 271/251 |
| 1253728 | 11/1967 | Fed. Rep. of Germany | 271/112 |
| 2046237 | 4/1971 | Fed. Rep. of Germany . | |
| 2245834 | 12/1973 | Fed. Rep. of Germany | 271/112 |
| 2064815 | 7/1971 | France . | |
| 0007568 | 1/1977 | Japan | 271/112 |
| 0018578 | 2/1979 | Japan | 271/112 |
| 0040179 | 3/1980 | Japan | 271/112 |
| 0199738 | 12/1982 | Japan | 271/126 |
| 0223748 | 11/1985 | Japan | 271/109 |
| 1303056 | 1/1973 | United Kingdom . | |

*Primary Examiner*—Joseph J. Rolla

*Attorney, Agent, or Firm*—Herbert L. Lerner; Laurence A. Greenberg

[57] ABSTRACT

A device for conveying sheets in a given travel direction includes a conveying head having a vacuum-applying device for removing an uppermost sheet from a pile of sheets and for maintaining the sheet under suction, the conveying head and the uppermost sheet being relatively movable in the given travel direction, the uppermost sheet being held against a sheet-contacting surface of the conveying head under suction, the conveying head having at least one rolling body surrounded by suction air and frictionally engageable with the uppermost sheet for moving the sheet in the given travel direction.

10 Claims, 5 Drawing Sheets

DEVICE FOR CONVEYING SHEETS, FOR EXAMPLE PAPER SHEETS

The invention relates to a device for conveying sheets such as paper sheets, for example.

Such devices are located ahead or upstream of sheet-fed printing presses in order to lift off the sheets from a pile of sheets and to lay them down suitably by means of reciprocating conveying heads, thereby achieving a stream feeding of the sheets. This means that, at the instant a sheet is to be lifted off, the converting heads, which are situated above the sheet pile, are provided with suction air, and then, after a suitable conveying distance or length of travel path has been traversed by the thus lifted sheet, the conveying heads are disconnected from the suction air for the purpose of releasing and transferring the sheet. The conveying distance is dependent upon the length of travel of the conveying heads.

It is an object of the invention to provide a conveying device of the aforementioned general type which is of such construction as to afford ease of manufacture, so that it is possible for different sheet-conveying distances or lengths of travel paths to be traversed, optionally with selective direction, while optimizing the conveying relationships by means of the conveying head. With the foregoing and other objects in view, there is provided, in accordance with the invention, a device for conveying sheets in a given travel direction, comprising a conveying head having vacuum-applying means for removing an uppermost sheet from a pile of sheets and for maintaining the sheet under suction, the conveying head and the uppermost sheet being relatively movable in the given travel direction, the uppermost sheet being held against a sheet-contacting surface of the conveying head under suction, the conveying head having at least one rolling body surrounded by suction air and frictionally engageable with the uppermost sheet for moving the sheet in the given travel direction.

In accordance with another feature of the invention, the rolling body is formed of a ball rotatable in all directions about a fixed mid-point thereof, the ball forming a dome projecting beyond the sheet-contacting surface of the conveying head, and at least one friction-wheel drive operatively associated with the ball for rotating the ball in the directions.

In accordance with a further feature of the invention, the device includes at least another friction-wheel drive, the friction-wheel drives being in engagement with the ball and being speed-controllable independently of one another. In accordance with an added feature of the invention, the sheet-contacting surface is formed with a pass-through opening through which the rolling body projects with a clearance forming a suction gap, the suction gap being connected to a vacuum source.

In accordance with an additional feature of the invention, the rolling body has a surface formed with suction holes and has means in the interior thereof for connecting the suction holes to a vacuum source.

In accordance with yet another feature of the invention, the rolling body is formed of elastic material.

In accordance with yet a further feature of the invention, the conveyor head is formed with a vacuum chamber surrounding the rolling body, and means disposed within the vacuum chamber are provided for supporting the rolling body therein.

In accordance with yet an added feature of the invention, the sheet-contacting surface is formed with suction-air openings spaced from the rolling body.

In accordance with yet an additional feature of the invention, the device includes a plurality of bearing balls in contact with and freely supporting the rolling body.

In accordance with another feature of the invention, the friction-wheel drives have friction wheels with drive axes extending perpendicularly to one another.

In accordance with a further feature of the invention, the rolling body has a surface with a friction coating formed thereon.

In accordance with an added feature of the invention, the device includes at least another conveying head, the conveying heads being disposed in a fixed arrangement one behind the other in the driven travel direction so that the uppermost sheet is transferable from head to head.

In accordance with a concomitant feature of the invention, the device includes means for controlling the friction-wheel drives as a function of the distance over which the uppermost sheet travels, and particularly so as to effect a change in direction and speed of the sheet.

The result of such a construction is a device of the aforementioned type having a wide range of application. In contrast with the prior art, one and the same conveying head can be used for attaining different sheet-conveying distances. The conveying head itself does not perform any conveying motion. It is always located above the sheet pile. After being removed form the pile, the uppermost sheet held by suction comes into frictional engagement with one or more rolling bodies of the conveying head, which are surrounded or shrouded by suction air, and, due to suitable driving of the rolling body, the sheet is conveyed to a suitable sheet station. Of course, this presupposes that the frictional force is greater than the suction force, to enable the sheet to be entrained when the rolling body turns. The suitable sheet-conveying distance or travel may be determined, for example, by the respective length of time for which the rolling body is driven. The rolling bodies themselves may be of various shapes. They may be cylindrical or barrel-shaped. In particular, however, it is advisable for them to be constructed in the form of balls. Due to the dome of the ball, projecting beyond the sheet-contacting surface of the conveying head, and due to the fact that the ball is rotatable in all directions about its fixed mid-point, it is possible for the sheet to be moved, in fact, in any direction in its plane. The direction of motion of the sheet will then agree with the plane of rotation of the ball. The shifting of the sheet in all different directions is possible by means of just two friction-wheel drives which are in contact engagement with the ball and are not disposed opposite one another. This affords an automatic correction of the disposition of the sheets in the pile. If both friction-wheel drives simultaneously set the ball in rotation, a diagonal movement of the sheet in relation to its original alignment then occurs. The angle of diagonal movement can be varied by the mutually independent rotational-speed control of the two friction-wheel drives. For example, with identical speeds of the friction-wheel drives and with identical friction-wheel diameters, the diagonal-conveying angle of the sheet will be 45°. If the sheet is scanned in a contactless manner, e.g. optically, and this is evaluated by a computer, and is transmitted as a command for the rotational-speed control of the friction-wheel drives, a possibility results of providing an optimum, gentle conveyance or transport of sheets into quite specific alignment positions or settings, e.g. of a processing machine, possibly a printing press.

The friction between the dome of the ball and the upper side of the sheet is increased by the suction gap connected to vacuum which is provided between the dome and the pass-through opening formed in the sheet-contacting surface. Once again, it is possible to vary the friction between the sheet and the dome by appropriate dimensioning of the vacuum. A further possibility of varying the friction between the dome and the sheet lies in forming suction holes in the surface of the ball, and connecting the interior of the ball to the vacuum source. The ball itself may be made from various materials. It is possible, in particular, however, to provide a ball formed of elastic material. Preferably, the dome should project approximately 1.5 mm from the sheet-contacting surface in order to obtain good transporting or conveyance of the sheet. A constructionally advantageous manner of connecting the gap and also the interior of the ball to the vacuum source is to accommodate the ball, including its bearing support or mounting, in the vacuum chamber. The vacuum chamber, in conjunction with the ball and the friction-wheel drives, forms the conveying head. The suction-air openings disposed at a distance from the ball serve to reduce the friction between the sheet and the sheet-contacting surface, with the result that the sheet is in full-area contact with the sheet-contacting surface.

In this connection, the suction force counteracts the force of gravity acting on the sheet. However, the suction force is selected to be of such strength that the force of the friction between the ball and the sheet is greater. For reliably positioning the ball, it is sufficient to have several bearing balls so located that the ball is braced against an upper bearing ball, and the lower half of the ball is engaged by three other bearing balls, thereby providing zero-play support. Advantages with regard to bearing support result from the fact that the drive axes of the friction wheels extend perpendicularly to one another, with the friction-wheel drives possibly being controlled by a computer. The entrainment of the sheet in the plane of rotation of the ball is improved by applying a suitable friction coating to the surface of the ball. The sheet-conveying distance or length of travel can be advantageously increased by disposing several conveying heads in a fixed arrangement in tandem or one behind the other in the travel or conveying direction of the sheet, with the sheet being transferred from head to head. In this manner, too, the sheets are conveyed very gently.

Other features which are considered as characteristic for the invention are set forth in the appended claims.

Although the invention is illustrated and described herein as embodied in a device for conveying sheets, such as paper sheets, for example, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 4:
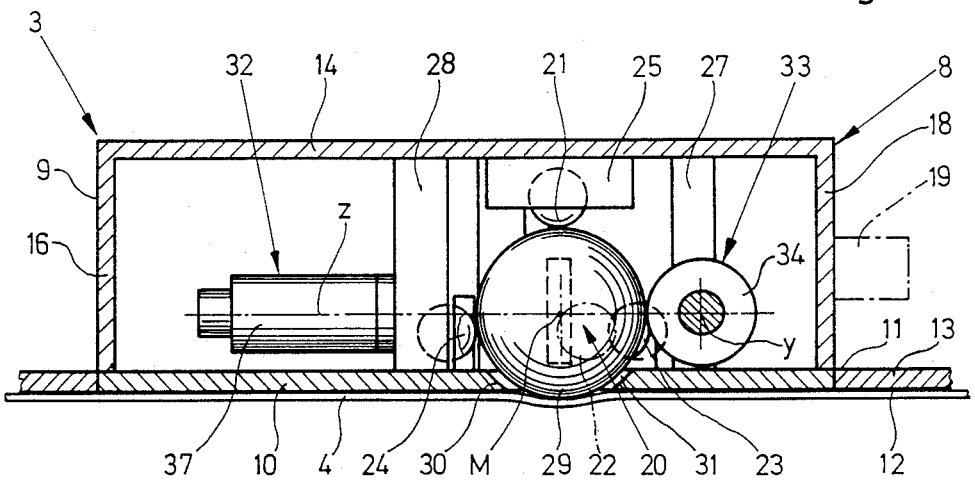
FIG. 4 is a cross-sectional view of FIG. 3 taken along the line IV—IV in the direction of the arrows.
Figure 5:
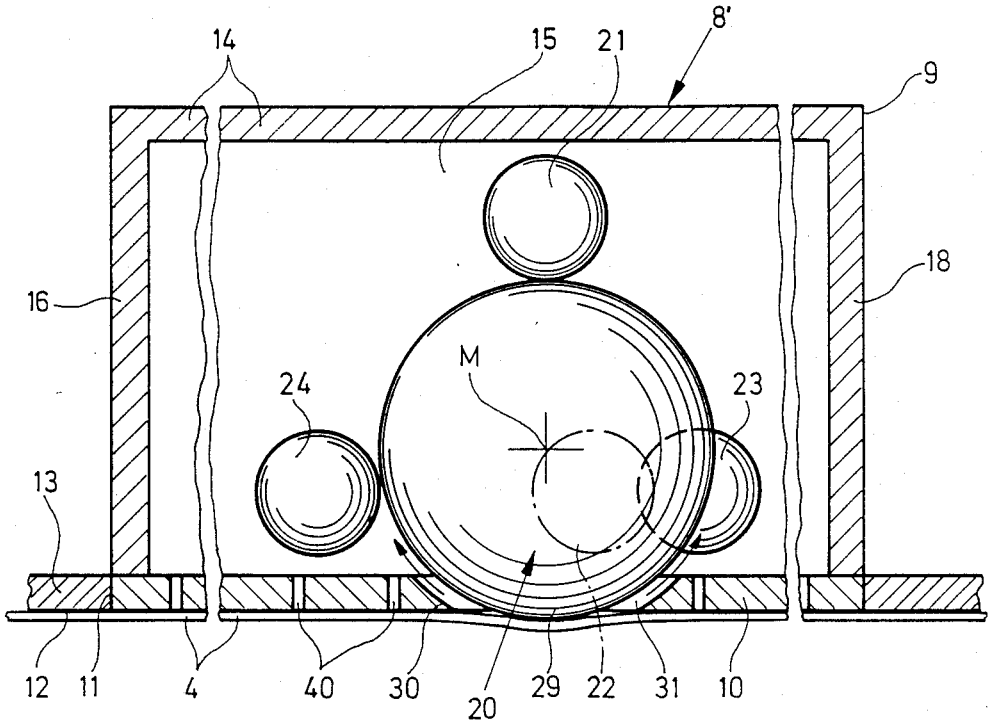
Figure 6:
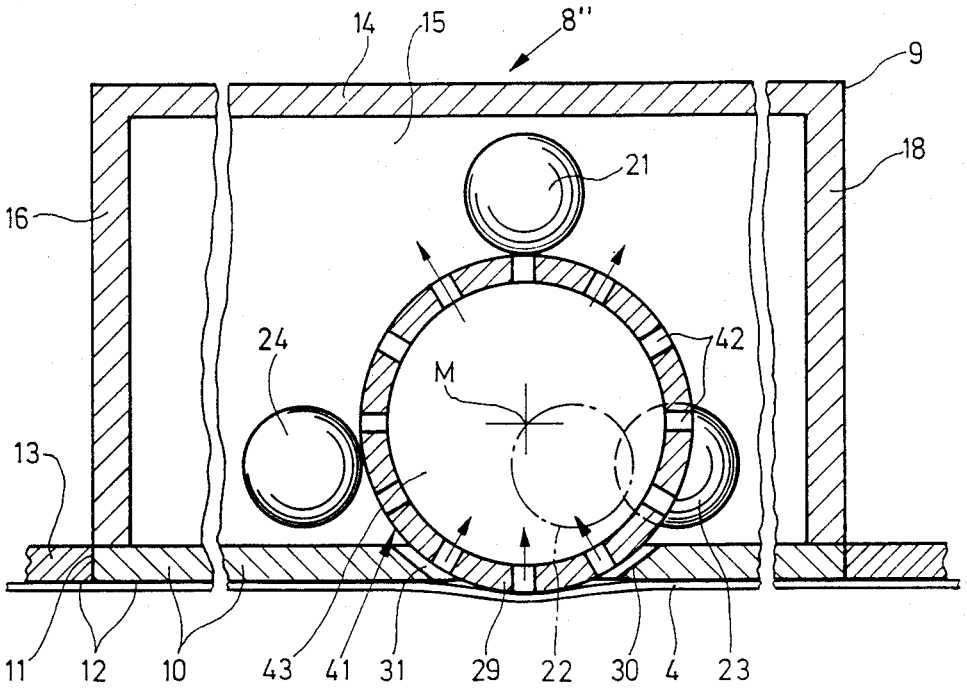

FIG. 5 is an enlarged, fragmentary and partly broken-away view of FIG. 4 showing another embodiment of the device in a diagrammatic representation with a ball disposed in a modified vacuum chamber and with suction-air openings provided in the closing plate at a distance from the ball; and FIG. 6 is a view similar to that of FIG. 5 of another embodiment of the device having a vacuum chamber with a ball disposed in the latter, but with the surface of the ball being formed with suction holes.

Figure 1:
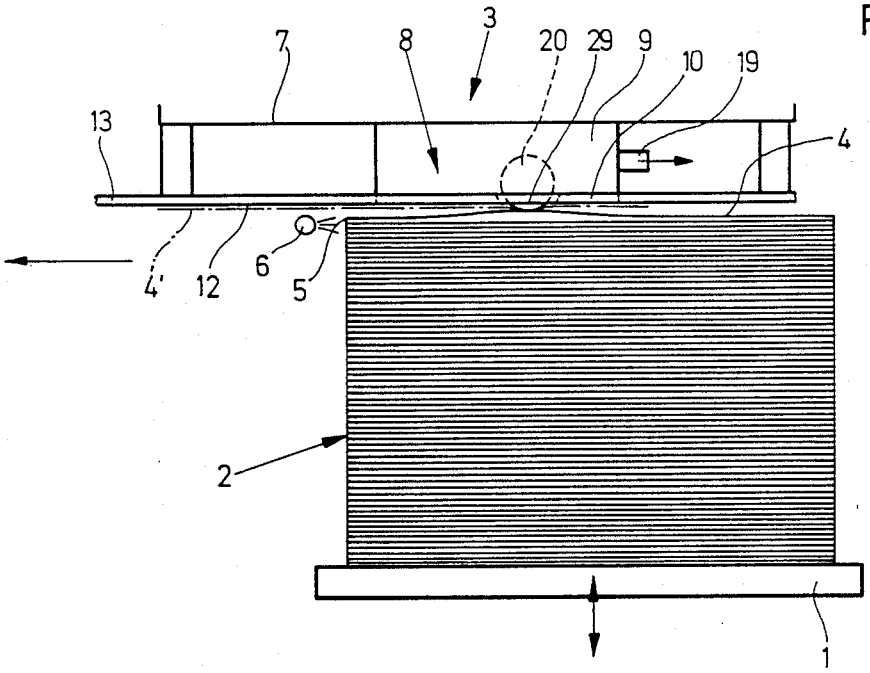
FIG. 1 is a diagrammatic front elevational view of a first embodiment of the sheet-conveying device according to the invention with a sheet-pile carrier which is adjustable in height.

Referring now to the drawing and, first, to FIG. 1 thereof, there is shown therein a vertically displaceable carrier 1 for holding a pile of sheets 2. Extending above the latter is a fixed i.e. stationary, device 3 for removing the uppermost sheet 4 and for conveying it in a horizontal direction x.

To facilitate the lifting-off of the uppermost sheet 4, a loosening fan or blower 6 is provided at an upper edge 5 of the pile which extends transversely to the sheet-conveying direction x.

The device 3 includes a horizontal carrier 7 with a downwardly directed conveying head 8 extending therefrom. The conveying head 8 is formed with a vacuum chamber 9, which is covered on the underside thereof by a closing plate 10. The latter passes in a form-fitting manner through an aperture 11 (Figs. 4 to 6) formed in a plate 13 which is aligned parallel to the horizontal carrier 7 and, in turn, forms a sheet-contacting surface 12. The closing plate 10 thus also constitutes a part of the sheet-contacting surface 12.

The surface chamber 9 is composed of a ceiling wall 14, downwardly directed side walls 15, 16, 17 and 18 extending away from the latter, and the closing plate 10, which engages the side walls 15,16,17 and 18 at the bottom edges thereof. The side wall 18 carries a connecting piece or union 19, which is connectible by a non-illustrated line to a vacuum source.

A ball 10, which is rotatable in all directions about a stationary mid-point M thereof, is held in the vacuum chamber 9 by four bearing balls 21, 22, 23, and 24 (FIGS. 3 and 4), which are in engagement with the surface of the ball 10. The bearing balls 21, 22, 23 and 24 are rotatably seated in small guide blocks or supports 25, 26, 27 and 28, respectively, which are attached to and extend from the ceiling wall 14. The bearing ball 21 supported by the small guide block 25 extends vertically upwardly from the mid-point M of the ball 20. The other three bearings ball 22, 23 and 24 are disposed in uniform or like circumferential distribution around the ball 20, lie in a common horizontal plane and are in contact with the spherical surface of the lower half of the ball 20, thereby positioning the ball 20. The small guide blocks 25, 26, 27 and 28 and the bearing balls 21, 22, 23 and 24 are so disposed that the ball 20 is held with zero play.

The ball 20 forms a dome 29 projecting above and beyond the sheet-contacting surface 12 of the conveying head 8 by approximately 1.5 mm. To enable the dome 29 generally to project beyond the sheet-contacting surface 12, a pass-through opening or hole 30 is formed in the closing plate 10. A suction gap 31 is defined by and between sides of the pass-through hole 30 and the surface of the ball 20 located at the same level therewith.

The ball 20 is driven by two friction-wheel drives 32 and 33, which are disposed perpendicularly to one another and are provided with respective friction wheels 34 and 35 with respective drive axes y and z, disposed perpendicularly to one another. The drive axes y and z run horizontally and extend to the level or height of the mid-point M of the ball 20.

Furthermore, the drive axis z is aligned so that is extends in the conveying direction x. Each of the friction-wheel drives 32 and 33 engages the surface of the ball 20 at the height of the mid-point M of the ball 20, and is formed with a respective direct-current motor 36, 37. The direct-current motors 36 and 37 are seated on small bearing blocks 38 and 39, respectively, extending from the ceiling wall 14. The diameters of the friction coating on the circumferences thereof in order to afford slip-free entrainment of the ball 20.

The device operates in the following manner. For the purpose of removing the uppermost sheet 4 from the sheet pile 2, the sheet-pile carrier 1 is moved closely up to the conveying head 8. With the support or aid of the loosening fan 6, the conveying head 8 is able to suck up the uppermost sheet in accordance with FIG. 1, through the suction gap 31, so that the uppermost sheet comes into contact with the sheet-contacting surface 12. If the friction-wheel drive 32, with its drive axis extending transversely to the conveying direction x, is then exclusively switched on, the plane of rotation of the ball 20 will align with the conveying direction and will, accordingly, move the sheet in this direction, as represented by the phantom view of the sheet 4' in FIG. 1. It is also possible, however, to move the sheet 4 diagonally with respect to the conveying direction x, in which case it is then necessary to turn on or engage both friction-wheel drives 32 and 33. If the friction wheels 34 and 35 in the embodiment shown in FIGS. 3 and 4 rotate at identical rotational speeds, the plane of rotation of the ball 20 will lie at an angle of 45° with respect to the sheet-conveying direction x. In this manner, it is possible to move the sheet 4 in any direction by means of rotational-speed control. To ensure that there is always a constant distance or spacing between the conveying head 8 and the uppermost sheet 4, the sheet-pile carrier 1 travels in an upward direction while the sheet 4 is being removed.

The suction force exerted on the sheet 4 is smaller, however, than the force of friction between the sheet 4 and the dome 29, with the result that, whenever the ball 20 is rotated, the sheet 4 is moved together therewith in the corresponding direction. The ball 20 is, preferably, in the form of an elastic sphere and is provided with a suitable friction coating. This improves the entrainment of the sheet. The entrainment behavior can also be varied, however, by the extent to which the dome 29 projects beyond the sheet-contacting surface 12. Furthermore, it is possible to affect the entrainment behavior by varying the size of the suction gap 31 and the amount of the vacuum.

Figure 3:
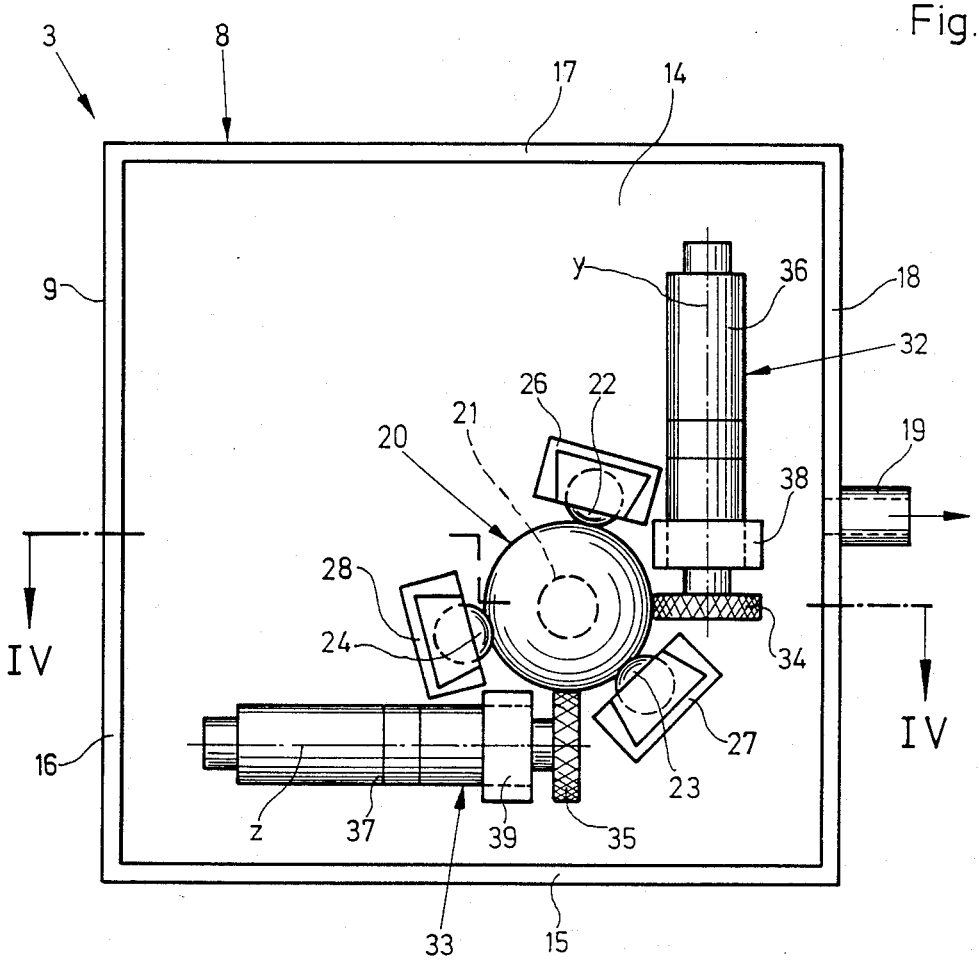
FIG. 3 is a bottom plan view of a vacuum chamber forming part of the sheet-conveying device according to the invention, with the closing plate removed from the bottom thereof.

The conveying head 8' shown in FIG. 5 has a modified construction when compared with the conveying head 8 previously described with respect to FIGS. 3 and 4. The closing plate 10', forming a part of the sheet-contacting surface 12, is provided with suction-air openings 40 spaced from the ball 20. The suction action on the sheet 4 is, therefore, more uniform. It counteracts the force of gravity acting upon the sheet 4. The total suction force exerted upon the sheet 4, however, is not as great as the force of the friction, with the result that, when the ball 20 is rotated, the sheet is transported in the desired direction.

In FIG. 6, which illustrates a further modified construction of a conveying head 8'', components identical with those shown in FIG. 5 bear identical reference characters. Deviating from the embodiment of the invention shown in FIG. 5, the surface of the ball 41 in the embodiment of FIG. 6 is formed with evenly distributed suction holes 42. Due to the fact that the vacuum chamber 9 surrounds the ball 41, the interior 43 of the ball 41 is thus also connected to the vacuum source. Accordingly, the suction air is able to act on the upper side of the sheet 4, on the one hand, through the suction gap 31 and, on the other hand, through the suction holes 42 in the region of the dome 29.

Figure 2:
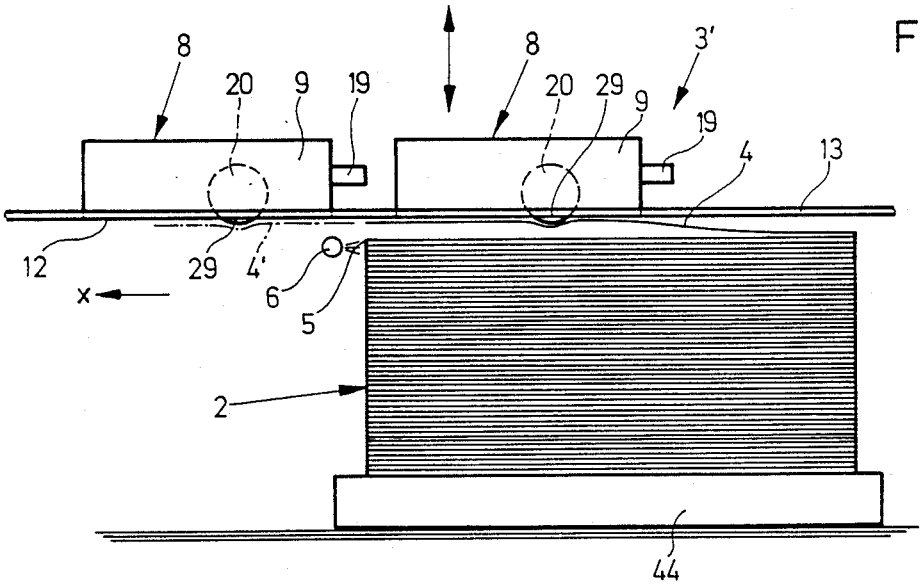
FIG. 2 is a diagrammatic view like that of FIG. 1 of a second embodiment of the device, with two conveying heads disposed in a fixed position extending one behind the other in the direction of conveying, the conveying heads being capable of executing vertical motion in the direction of the pile of sheets.

In the modified embodiment of the device 3' shown in FIG. 2, a fixed carrier 44 is used for holding the sheet pile 2. Furthermore, two conveying heads 8 are provided which are disposed in a fixed arrangement behind one another i.e. in tandem, in the sheet-conveying direction x in order to permit the transfer of the uppermost sheet 4 from head to head (note the sheet 4' shown in phantom in FIG. 2). The construction of the conveying heads 8 of FIG. 2 is identical to that of the conveying heads aforedescribed with respect to the other illustrated embodiments.

In order to be able to maintain a constant spacing or distance between the sheet pile 2 and the conveying head 8, which is situated above the sheet pile 2, the device 3' is displaceable in vertical direction.

In this last-described embodiment, the sheets can also be moved in a direction deviating from the conveying direction x by suitably driving the ball 20.

The foregoing is a description corresponding in substance to German Application P 37 10 258.3, dated Mar. 28, 1987, the International priority of which is being claimed for the instant application, and which is hereby made part of this specification and the aforementioned corresponding German application are to be resolved in favor of the latter.

We claim:

1. Device for conveying sheets in a given travel direction, comprising a conveying head having vacuum-applying means for removing an uppermost sheet from a pile of sheets and for maintaining the sheet under suction, said conveying head and the uppermost sheet being movable relative to one another in the given travel direction, the uppermost sheet being held against a sheet-contacting surface of said conveying head under suction, said conveying head have at least one rolling body surrounded by suction air and frictionally engageable with the uppermost sheet for moving the sheet in the given travel direction, the rolling body being formed of a ball rotatable in all directions about a fixed mid-point thereof, said ball forming a dome projecting beyond said sheet-contacting surface of said conveying head, and at least one friction-wheel drive operatively associated with said ball for rotating said ball in said directions, and at least another friction-wheel drive, said friction-wheel drives being in engagement with said ball and being speedcontrollable independently of one another.

2. Device according to claim 1, wherein said sheet-contacting surface is formed with a pass-through opening through which said rolling body projects with a clearance forming a suction gap, said suction gap being connected to a vacuum source.

3. Device according to claim 1, wherein said rolling body has a surface formed with a suction holes and has means in the interior thereof for connecting said suction holes to a vacuum source.

4. Device according to claim 1, wherein said rolling body is formed of elastic material.

5. Device according to claim 1, wherein said conveyor head is formed with a vacuum chamber surrounding said rolling body, and including means disposed within said vacuum chamber for supporting said rolling body therein.

6. Device according to claim 1, wherein said sheet-contacting surface is formed with suction-air openings spaced from said rolling body.

7. Device according to claim 1, including a plurality of bearing balls in contact with and freely supporting said rolling body.

8. Device according to claim 1, wherein said friction-wheel drives have friction wheels with drive axes extending perpendicularly to one another.

9. Device according to claims 1, wherein said rolling body has a surface with a friction coating formed thereon.

10. Device according to claim 1, including at least another conveying head, said conveying heads being disposed in a fixed arrangement behind the other in the given travel direction so that the uppermost sheet is transferable from head to head.

* * * * *